US009812847B2

(12) United States Patent
Sasada et al.

(10) Patent No.: US 9,812,847 B2
(45) Date of Patent: Nov. 7, 2017

(54) IONIZER

(71) Applicant: SMC CORPORATION, Chiyoda-ku (JP)

(72) Inventors: Naoto Sasada, Taito-ku (JP); Suguru Konno, Tsukubamirai (JP); Takashi Yasuoka, Moriya (JP)

(73) Assignee: SMC CORPORATION, Chiyoda-ku (JP)

( * ) Notice: Subject to any disclaimer, the term of this patent is extended or adjusted under 35 U.S.C. 154(b) by 216 days.

(21) Appl. No.: 14/932,012

(22) Filed: Nov. 4, 2015

(65) Prior Publication Data

US 2016/0157328 A1 Jun. 2, 2016

(30) Foreign Application Priority Data

Dec. 2, 2014 (JP) ..... 2014-244225

(51) Int. Cl.
*H01T 23/00* (2006.01)

(52) U.S. Cl.
CPC ..... *H01T 23/00* (2013.01)

(58) Field of Classification Search
CPC ..... H01T 23/00
USPC ..... 361/213
See application file for complete search history.

(56) References Cited

U.S. PATENT DOCUMENTS 5,241,449 A * 8/1993 Moeller ..... H01T 23/00 315/51
5,930,105 A * 7/1999 Pitel ..... H01T 23/00 361/212
6,088,211 A * 7/2000 Pitel ..... H01T 23/00 361/212
6,850,403 B1 * 2/2005 Gefter ..... H01T 23/00 361/225
7,180,722 B2 * 2/2007 Jacobs ..... H01T 23/00 361/230

(Continued)

FOREIGN PATENT DOCUMENTS

JP 4687716 5/2011
JP 5508302 5/2014

*Primary Examiner* — Stephen W Jackson
(74) *Attorney, Agent, or Firm* — Oblon, McClelland, Maier & Neustadt, L.L.P.

(57) ABSTRACT

An ionizer includes: a positive-side transformer, and a negative-side transformer; a positive-side high-voltage output circuit that has a first input terminal and a second input terminal that are respectively connected to a ground terminal and a power supply terminal, the ground terminal and power supply terminal being provided on the secondary of the positive-side transformer, and also has a first output terminal from which a direct-current positive high voltage is output; a negative-side high-voltage output circuit that has a third input terminal and a fourth input terminal that are respectively connected to a ground terminal and a power supply terminal, the ground terminal and power supply terminal being provided on the secondary of the negative-side transformer, and also has a second output terminal from which a direct-current negative high voltage is output; and a discharge electrode connected to the first output terminal. The ground terminal in the positive-side transformer and the first input terminal in the positive-side high-voltage output circuit are mutually connected through an attenuating capacitor.

4 Claims, 3 Drawing Sheets

(56) References Cited

U.S. PATENT DOCUMENTS

| | | | | |
|---|---|---|---|---|
| 7,973,292 | B2 * | 7/2011 | Tsumori | H01T 23/00 250/423 F |
| 9,025,302 | B2 * | 5/2015 | Hariya | H01T 23/00 361/230 |
| 9,338,867 | B2 * | 5/2016 | Toshida | H01T 19/04 |
| 9,351,386 | B2 * | 5/2016 | Toshida | H01T 23/00 |
| 2009/0230297 | A1 | 9/2009 | Mizutani | |

* cited by examiner

IONIZER

TECHNICAL FIELD

The present invention relates to a pulse AC method ionizer that alternately generates positive ions and negative ions from a discharge electrode common to a positive side and a negative side to remove charges from a charge body (neutralize the charge body).

BACKGROUND ART

A known pulse AC method ionizer that alternately generates positive ions and negative ions from a discharge electrode common to a positive side and a negative side to remove charges from a charge body is described in, for example, Patent literature (PTL) 1. This known ionizer has a high-voltage generating circuit as illustrated in FIG. 3. This high-voltage generating circuit has a positive-side transformer 32*a*, the primary side of which is connected to an alternating current power supply 30*a* by a switch 31*a*, and a negative-side transformer 32*b*, the primary side of which is connected to an alternating current power supply 30*b* by a switch 31*b*, the positive-side transformer 32*a* and negative-side transformer 32*b* being alternately connected to the alternating current power supply 30*a* and alternating current power supply 30*b*, respectively. The high-voltage generating circuit also has a positive-side high-voltage output circuit 33*a* connected to the secondary side of the positive-side transformer 32*a*, a negative-side high-voltage output circuit 33*b* connected to the secondary side of the negative-side transformer 32*b*, and a discharge electrode 34 connected to the positive-side high-voltage output circuit 33*a* and negative-side high-voltage output circuit 33*b* so as to be common to them. The positive-side high-voltage output circuit 33*a* and negative-side high-voltage output circuit 33*b* are alternately connected to the alternating current power supply 30*a* and alternating current power supply 30*b* through the transformer 32*a* and transformer 32*b*, respectively, so that the positive-side high-voltage output circuit 33*a* and negative-side high-voltage output circuit 33*b* alternately generate a positive high voltage and a negative high voltage, respectively. The generated positive high voltage and negative high voltage are alternately output to the discharge electrode 34, alternatively generating positive and negative ions from the discharge electrode 34.

The positive-side high-voltage output circuit 33*a* and negative-side high-voltage output circuit 33*b* are each formed with a Cockcroft-Walton circuit that includes a plurality of capacitors C and a plurality of diodes D.

Similar high-voltage generating circuits are also disclosed in PTL 2.

In the above ionizer, an output terminal 35 in the negative-side high-voltage output circuit 33*b* and an input terminal 36 in the positive-side high-voltage output circuit 33*a* are mutually connected with a connection line 37 so that when the positive-side high-voltage output circuit 33*a* and negative-side high-voltage output circuit 33*b* are mutually connected, an output from the negative-side high-voltage output circuit 33*b* becomes a reference potential of the positive-side high-voltage output circuit 33*a*. In this case, a ground terminal 38 in the positive-side transformer 32*a* and the input terminal 36 are isolated from each other by being disconnected from each other. Since the ground terminal 38 and input terminal 36 are isolated from each other in this way, there is the merit that the withstand voltage of the positive-side transformer 32*a* can be reduced.

When the ground terminal 38 and input terminal 36 are isolated from each other, however, alternate currents I1 and I2 generated due to a secondary voltage of the positive-side transformer 32*a* flows into both the positive-side high-voltage output circuit 33*a* and the negative-side high-voltage output circuit 33*b* during boosting by the positive-side high-voltage output circuit 33*a* as illustrated in FIG. 3, so their flow paths are prolonged. This is problematic in that the efficiency of generating the positive high voltage is lowered and the positive high voltage applied to the discharge electrode 34 is thereby lowered.

The alternate current I1 is a current at a time when the voltage on the secondary side of the transformer 32*a* is applied upward in the drawing. The alternate current I2 is a current at a time when the voltage on the secondary side of the transformer 32*a* is applied downward in the drawing.

The Cockcroft-Walton circuit is a circuit in which rectification by the diodes D and smoothing by the capacitors C are combined together to output a boosted direct-current high voltage. Since, in this circuit, the capacitors C repeat charging and discharging during smoothing, an alternating current component is superimposed on a direct-current high voltage Vo output from the high-voltage output circuits 33*a* and 33*b*, so the direct-current high voltage Vo has a ripple waveform as illustrated in FIG. 4. The ripple voltage is indicated by Vp. The symbol Vt in the drawing indicates the secondary voltage of the transformers 32*a* and 32*b*.

During operation of the negative-side high-voltage output circuit 33*b*, therefore, when a negative high voltage entered from the output terminal 35 of the negative-side high-voltage output circuit 33*b* to the input terminal 36 of the positive-side high-voltage output circuit 33*a* passes through the positive-side high-voltage output circuit 33*a*, the ripple voltage Vp is boosted by the positive-side high-voltage output circuit 33*a*. As a result, another voltage arises that a negative high voltage output to the discharge electrode 34 is lowered. The negative high voltage is lowered at each connection stage in the Cockcroft-Walton circuit.

CITATION LIST

Patent Literature

[PTL 1] Japanese Patent No. 5508302
[PTL 2] Japanese Patent No. 4687716

SUMMARY OF INVENTION

Technical Problem

A technical object of the present invention is to improve, in a pulse AC method ionizer, the efficiency with which a positive-side high-voltage output circuit generates a positive high voltage without increasing the withstand voltage of a positive-side transformer and to prevent a drop in output of a negative high voltage at a discharge electrode by lowering a ripple voltage generated at an output terminal in a negative-side high-voltage output circuit.

Solution to Problem

To achieve the above object, the ionizer according to the present invention includes: a positive-side transformer and a negative-side transformer, each of which has a primary side and a secondary side, the primary sides of the positive-side transformer and negative-side transformer being alternately connected to their respective alternating current power supplies by a switch mechanism, and also has a ground terminal and a power supply terminal on the secondary side; a positive-side high-voltage output circuit that has a first input terminal, a second input terminal, and a first output terminal, the first input terminal being connected to the ground terminal in the positive-side transformer, the second input terminal being connected to the power supply terminal in the positive-side transformer, a direct-current positive high voltage being output from the first output terminal; a negative-side high-voltage output circuit that has a third input terminal, a fourth input terminal, and a second output terminal, the third input terminal being connected to the ground terminal in the negative-side transformer, the fourth input terminal being connected to the power supply terminal in the negative-side transformer, a direct-current negative high voltage being output from the second output terminal; a discharge electrode connected to the first output terminal in the positive-side high-voltage output circuit; a ripple-voltage attenuating capacitor that mutually connects the ground terminal in the positive-side transformer and the first input terminal in the positive-side high-voltage output circuit; and a connection line that mutually connects the second output terminal in the negative-side high-voltage output circuit and the first input terminal in the positive-side high-voltage output circuit.

In the present invention, the first output terminal and first input terminal in the positive-side high-voltage output circuit are preferably connected mutually through a first resistor, and the second output terminal and third input terminal in the negative-side high-voltage output circuit are preferably connected mutually through a second resistor.

In the present invention, the positive-side high-voltage output circuit and negative-side high-voltage output circuit are each formed with a Cockcroft-Walton circuit including diodes and capacitors.

Advantageous Effects of Invention

According to the present invention, since the ground terminal in the positive transformer and the first input terminal in the positive-side high-voltage output circuit are mutually connected through a ripple-voltage attenuating capacitor, it is possible to improve the efficiency with which the positive-side high-voltage output circuit generates a positive high voltage without increasing the withstand voltage of the positive-side transformer and to prevent a drop in output of a negative high voltage at the discharge electrode by lowering a ripple voltage generated at the output terminal in the negative-side high-voltage output circuit.

DESCRIPTION OF EMBODIMENTS

Figure 1:
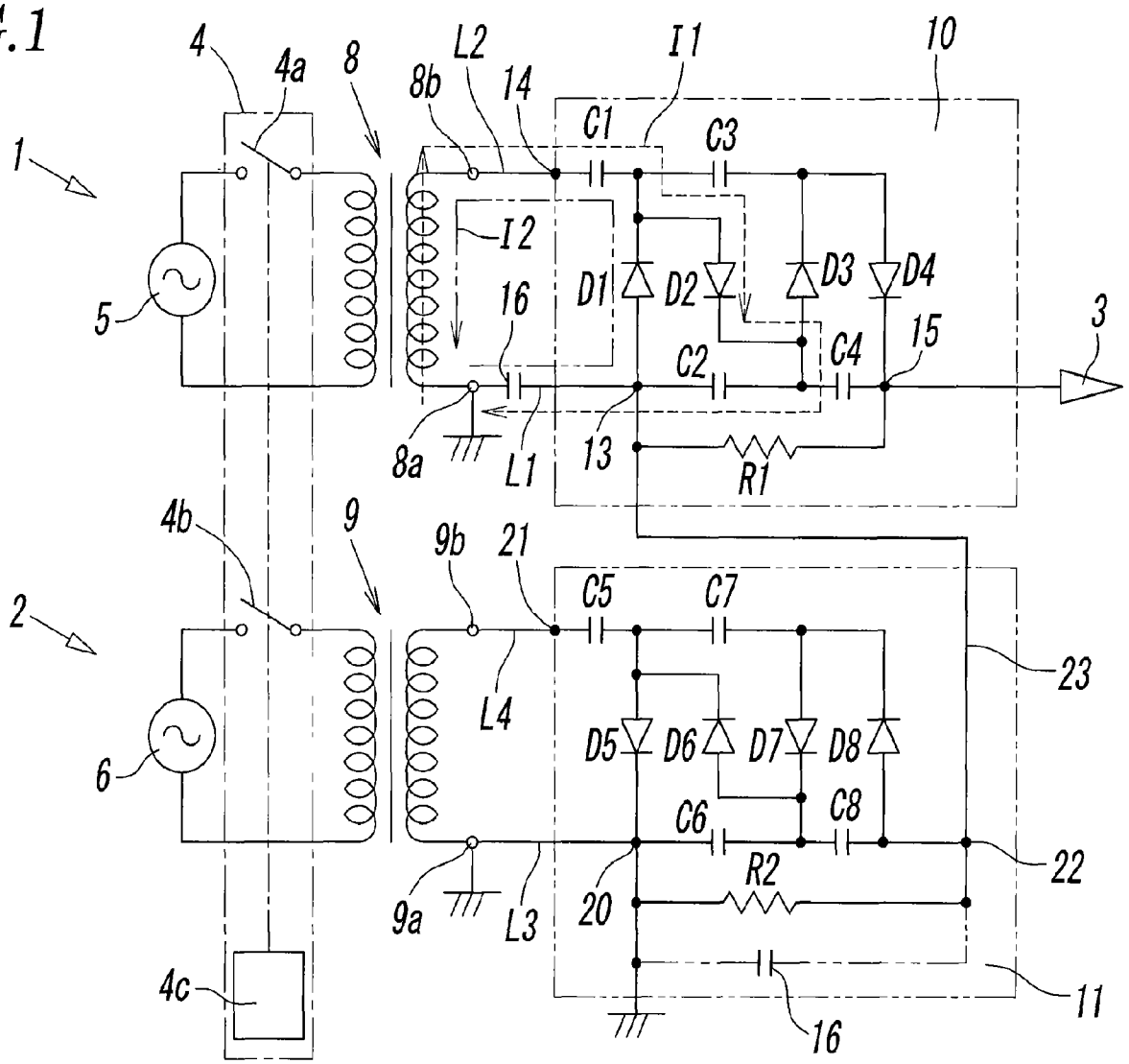
FIG. 1 illustrates a circuit that is a first embodiment of an ionizer according to the present invention.

FIG. 1 illustrates a circuit that is a first embodiment of a pulse AC method ionizer according to the present invention. The ionizer includes a positive-side high-voltage generator 1, a negative-side high-voltage generator 2, and a discharge electrode 3 connected to the positive-side high-voltage generator 1 and negative-side high-voltage generator 2 so as to be common to them. The positive-side high-voltage generator 1 and negative-side high-voltage generator 2 are alternately connected to alternating current power supplies 5 and 6, respectively, by a switch mechanism 4 so that the high-voltage generators 1 and 2 alternately generate a positive high voltage and a negative voltage, respectively. The generated high-voltage and negative high voltage are alternately output to the discharge electrode 3, alternatively generating positive and negative ions from the discharge electrode 3.

The positive-side high-voltage generator 1 includes a positive-side transformer 8 having a primary side and a secondary side, a first alternating current power supply 5 connected to the primary side of the positive-side transformer 8 through a first switch 4*a*, and a positive-side high-voltage output circuit 10 connected to a ground terminal 8*a* and a power supply terminal 8*b*, the ground terminal 8*a* and power supply terminal 8*b* being provided on the secondary side of the positive-side transformer 8.

The positive-side high-voltage output circuit 10 is formed with a Cockcroft-Walton circuit including four diodes D1 to D4 and four capacitors C1 to C4, which form two-stage connections. The positive-side high-voltage output circuit 10 has a first input terminal 13, a second input terminal 14, and a first output terminal 15. The first input terminal 13 is connected to the ground terminal 8*a* in the positive-side transformer 8 through a ripple-voltage attenuating capacitor (referred to below as the attenuating capacitor) 16. The second input terminal 14 is connected to the power supply terminal 8*b* in the positive-side transformer 8. The discharge electrode 3 is connected to the first output terminal 15. The first output terminal 15 and first input terminal 13 are mutually connected through a first resistor R1.

Of the four diodes D1 to D4, the two diodes D1 and D3 are connected between a ground line L1 connected to the ground terminal 8*a*, which is grounded, and a power supply line L2 connected to the power supply terminal 8*b*, which is not grounded, the ground line L1 and power supply line L2 being included in the positive-side transformer 8, so that the diodes D1 and D3 are placed in the forward direction with respect to a current flowing from the ground line L1 toward the power supply line L2. Conversely, the remaining two diodes D2 and D4 are connected so that they are placed in the forward direction with respect to a current flowing from the power supply line L2 toward the ground line L1. Of the four capacitors C1 to C4, the two capacitors C1 and C3 are connected in series on the power supply line L2. The remaining two capacitors C2 and C4 are connected in series on the ground line L1.

The negative-side high-voltage generator 2 includes a negative-side transformer 9 having a primary side and a secondary side, a second alternating current power supply 6 connected to the primary side of the negative-side transformer 9 through a second switch 4*b*, and a negative-side high-voltage output circuit 11 connected to a ground terminal 9*a* and a power supply terminal 9*b*, the ground terminal 9*a* and power supply terminal 9*b* being provided on the secondary side of the negative-side transformer 9.

The negative-side high-voltage output circuit 11 is formed with a Cockcroft-Walton circuit including four diodes D5 to D8 and four capacitors C5 to C8, which form two-stage connections. The negative-side high-voltage output circuit 11 has a third input terminal 20, a fourth input terminal 21, and a second output terminal 22. The third input terminal 20 is connected to the ground terminal 9*a* in the negative-side transformer 9. The fourth input terminal 21 is connected to the power supply terminal 9*b* in the negative-side transformer 9. The second output terminal 22 is connected to the first input terminal 13 in the positive-side high-voltage output circuit 10 with a connection line 23. The second output terminal 22 and third input terminal 20 are mutually connected through a second resistor R2.

Of the four diodes D5 to D8, the two diodes D5 and D7 are connected between a ground line L3 connected to the ground terminal 9*a* and a power supply line L4 connected to the power supply terminal 9*b*, the ground line L3 and power supply line L4 being included in the negative-side transformer 9, so that the diodes D5 and D7 are placed in the forward direction with respect to a current flowing from the power supply line L4 toward the ground line L3. Conversely, the remaining two diodes D6 and D8 are connected so that they are placed in the forward direction with respect to a current flowing from the ground line L3 toward the power supply line L4. Of the four capacitors C5 to C8, the two capacitors C5 and C7 are connected in series on the power supply line L4. The remaining two capacitors C6 and C8 are connected in series on the ground line L3.

Although, in this embodiment, the diodes D1 to D8 and capacitors C1 to C8 in the positive-side high-voltage output circuit 10 and negative-side high-voltage output circuit 11 are connected in two stages, they can also be connected in three or more stages.

The first switch 4*a* and second switch 4*b* form the switch mechanism 4 together with a control circuit 4*c*. When the control circuit 4*c* alternately opens and closes the first switch 4*a* and second switch 4*b*, the positive-side transformer 8 and negative-side transformer 9 are alternately connected to the alternating current power supplies 5 and 6, respectively.

In the ionizer having the structure described above, when the control circuit 4*c* in the switch mechanism 4 closes the first switch 4*a* and opens the second switch 4*b*, the primary side of the positive-side transformer 8 is connected to the alternating current power supply 5 and an alternating current secondary voltage generated on the secondary side of the positive-side transformer 8 is applied to the positive-side high-voltage output circuit 10 through the power supply terminal 8*b* and ground terminal 8*a*.

In the positive-side high-voltage output circuit 10, therefore, each time the polarity of the secondary voltage is inverted, the diodes D1 to D4 are sequentially brought into conduction, sequentially charging the capacitors C1 to C4. Finally, a direct-current positive high voltage, which has been rectified, smoothed, and boosted, is output from the first output terminal 15. This positive high voltage is applied to the discharge electrode 3, causing positive ions to be released from the discharge electrode 3.

Figure 3:
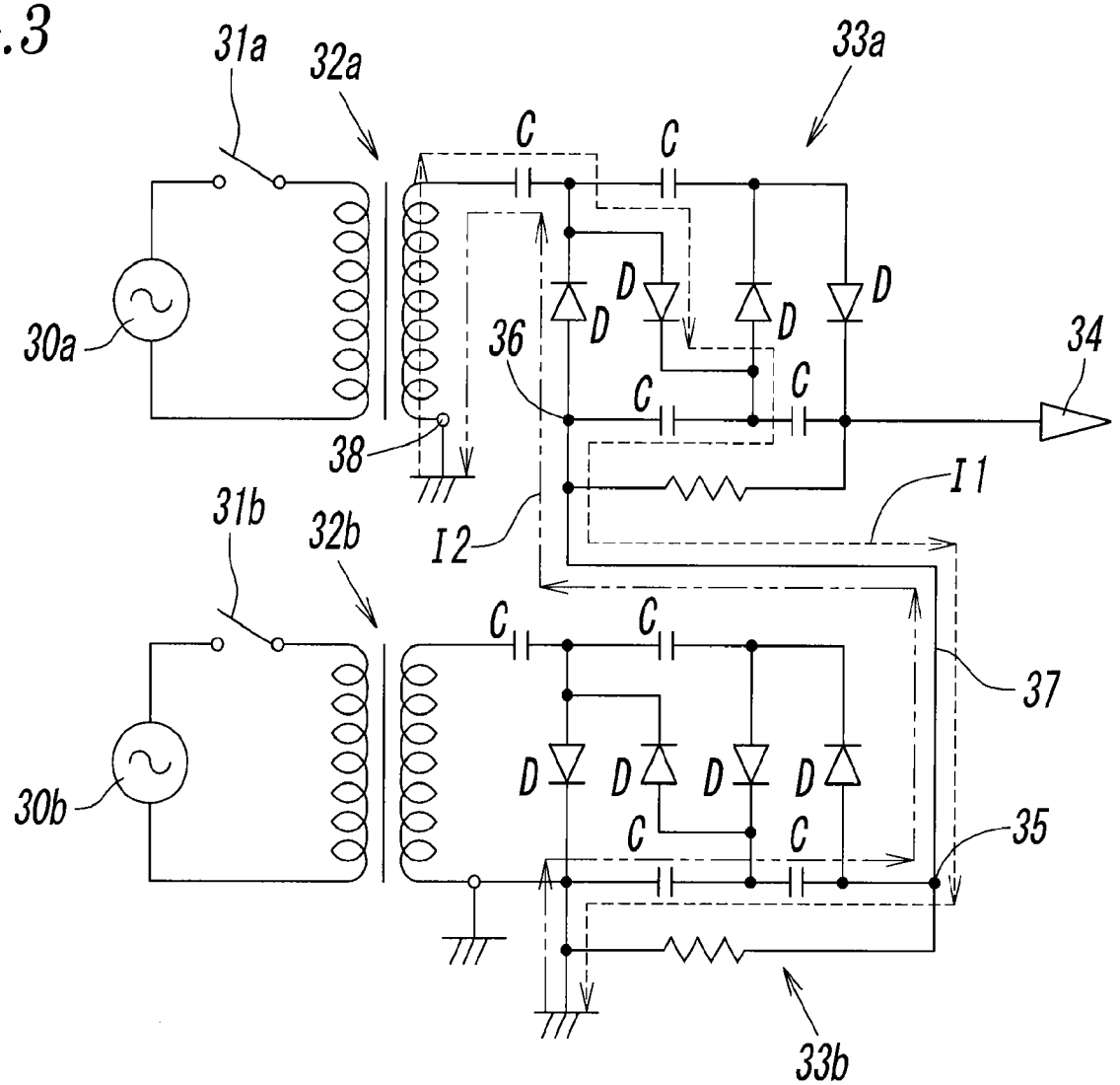
FIG. 3 illustrates a known ionizer.

At this time, flow paths through which alternate currents I1 and I2 generated by the secondary voltage of the positive-side transformer 8 flow are restricted to the inside of the positive-side high-voltage output circuit 10, as illustrated in FIG. 1. These flow paths are very short when compared with the known ionizer in FIG. 3. Accordingly, the efficiency of generating a positive high voltage is improved when compared with the known ionizer in FIG. 3.

The alternate current I1 is a current that flows when the voltage on the secondary side of the positive-side transformer 8 is applied upward in the drawing. The alternate current I2 is a current that flows when the voltage on the secondary side of the positive-side transformer 8 is applied downward in the drawing.

The ionizer in the present invention, which has the attenuating capacitor 16 as illustrated in FIG. 1, and an ionizer, used for comparison, that has a circuit structure in which the attenuating capacitor 16 is removed and the ground terminal 8*a* and first input terminal 13 are isolated from each other (see FIG. 3) were used in experimentations carried out under the conditions that the number of connection stages in the Cockcroft-Walton circuit in each ionizer is 4, the capacitance of each capacitor in the circuit is 100 pF, the capacitance of the attenuating capacitor 16 is 68 pF, and the input voltage of the positive-side transformer 8 is 8 V. With the ionizer in the present invention, the positive high voltage applied to the discharge electrode 3 was 6.0 kV. With the ionizer used for comparison, however, the positive high voltage applied to the discharge electrode 3 was 5.8 kV. It was found that when the attenuating capacitor 16 is provided, the output voltage is increased by 200 V.

When the first switch 4*a* is opened, charges stored in the capacitors C1 to C4 in the positive-side high-voltage output circuit 10 are released through the first resistor R1.

Next, when the control circuit 4*c* in the switch mechanism 4 closes the second switch 4*b* and opens the first switch 4*a*, the primary side of the negative-side transformer 9 is connected to the alternating current power supply 6 and an alternating current secondary voltage generated on the secondary side of the negative-side transformer 9 is applied to the negative-side high-voltage output circuit 11 through the power supply terminal 9*b* and ground terminal 9*a*.

In the negative-side high-voltage output circuit 11, therefore, each time the polarity of the secondary voltage is inverted, the diodes D5 to D8 are sequentially brought into conduction, sequentially charging the capacitors C5 to C8. Finally, a direct-current negative high voltage, which has been rectified, smoothed, and boosted, is output from the second output terminal 22. This negative high voltage is entered into the first input terminal 13 in the positive-side high-voltage output circuit 10 through the connection line 23 and is then applied to discharge electrode 3, causing negative ions to be released from the discharge electrode 3.

Figure 2:
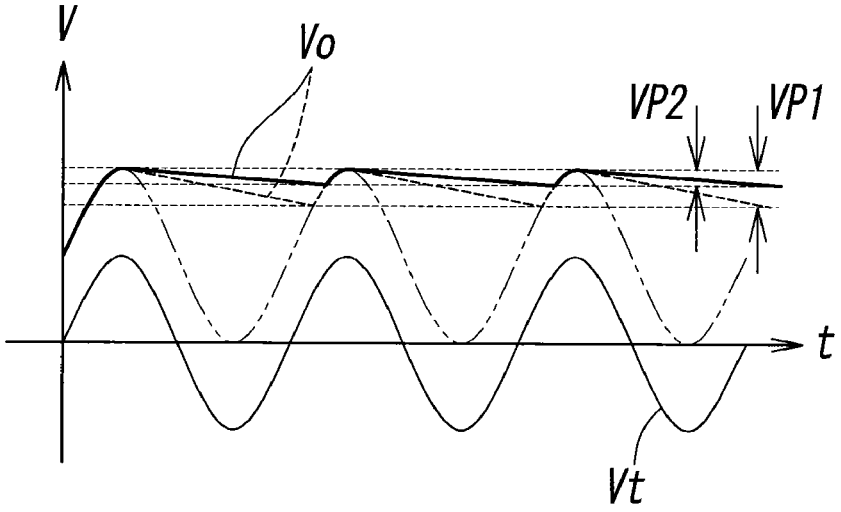
FIG. 2 is a schematic diagram illustrating a ripple voltage attenuation effect by an attenuating capacitor.
Figure 4:
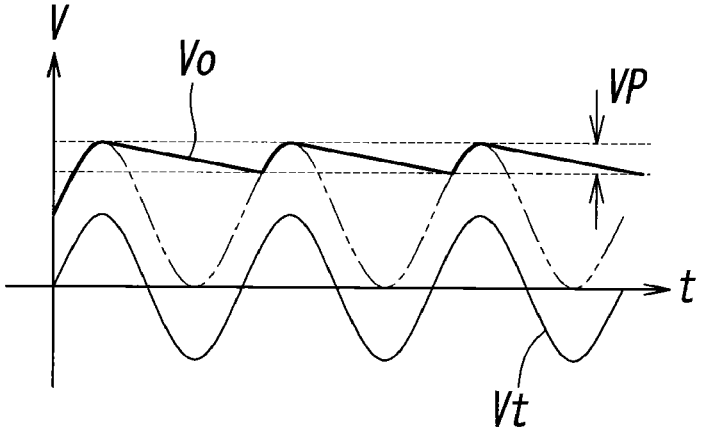
FIG. 4 is a schematic diagram illustrating a ripple voltage output from an output terminal in a high-voltage output circuit in the known ionizer.

At this time, an alternating current component is superimposed on a direct-current negative high voltage Vo output from the high-voltage output circuit 11, so the direct-current negative high voltage Vo has a ripple waveform as illustrated in FIG. 2. If, however, the attenuating capacitor 16 is not provided, part of the waveform is changed as indicated by the chained lines. The ripple voltage at that time is Vp1.

Since, however, the attenuating capacitor 16 is connected between the ground terminal 8*a* in the positive-side transformer 8 and the first input terminal 13 in the positive-side high-voltage output circuit 10, the negative high voltage Vo with a ripple is smoothed as indicated by the solid line in FIG. 2. The ripple voltage at that time is attenuated to Vp2.

That is, the placement of the attenuating capacitor 16 has the same effect as when the attenuating capacitor 16 is connected between the second output terminal 22 and third input terminal 20 in parallel to the capacitors C5 and C6 as indicated by a chained line in FIG. 1. Accordingly, the capacitance along the ground line L3 is increased by the attenuating capacitor 16 and capacitors C5 and C6. When the capacitance is increased in this way, a discharge time during smoothing operation is prolonged, the ripple voltage of the negative high voltage at the second output terminal 22 is reduced.

As a result, when the negative high voltage passes through the positive-side high-voltage output circuit 10, a ratio by which the ripple voltage is boosted by the positive-side high-voltage output circuit 10 is reduced, preventing a drop in output of the negative high voltage applied to the discharge electrode 3.

The symbol Vt in FIG. 2 indicates the secondary voltage of the transformer 9.

The direct-current negative high voltage entered from the second output terminal 22 in the negative-side high-voltage output circuit 11 to the first input terminal 13 in the positive-side high-voltage output circuit 10 is shut off by the attenuating capacitor 16 and is not thereby entered into the ground terminal 8*a* in the positive-side transformer 8. This eliminates the need for the positive-side transformer 8 to withstand a high voltage.

The ionizer in the present invention, which has the attenuating capacitor 16 as illustrated in FIG. 1 and an ionizer, used for comparison, that has a circuit structure in which the attenuating capacitor 16 is removed and the ground terminal 8*a* and first input terminal 13 are isolated from each other (see FIG. 3) were used to measure the negative high voltage applied to the discharge electrode 3 under the conditions that the number of connection stages in the Cockcroft-Walton circuit in each ionizer is 4, the capacitance of each capacitor in the circuit is 100 pF, the capacitance of the attenuating capacitor 16 is 68 pF, and the input voltage of the positive-side transformer 8 is 8 V. The negative high voltage in the ionizer in the present invention was −5.7 kV while the negative high voltage in the ionizer used for comparison was −5.4 kV. From this result, it was confirmed that since the ripple voltage is attenuated by the attenuating capacitor 16, a drop in the negative high voltage applied to the discharge electrode 3 can be greatly suppressed.

When the second switch 4*b* is opened, charges stored in the capacitors C5 to C8 in the negative-side high-voltage output circuit 11 are released through the second resistor R2.

As described above in detail, in this embodiment, the ground terminal 8*a* in the positive-side transformer 8 and first input terminal 13 in the positive-side high-voltage output circuit 10 are mutually connected through the attenuating capacitor 16. This is advantageous in that during the operation of the positive-side high-voltage generator 1, a path through which an alternate current generated due to the secondary voltage of the positive-side transformer 8 is shortened and the efficiency of generating a positive high voltage is thereby improved and that during the operation of the negative-side high-voltage generator 2, the ripple voltage superimposed on the negative high voltage output from the second output terminal 22 in the negative-side high-voltage output circuit 11 is smoothed by the attenuating capacitor 16 and is thereby attenuated and a drop in output of the negative high voltage applied to the discharge electrode 3 is thereby prevented.

REFERENCE SIGNS LIST

3: discharge electrode
4: switch mechanism
5, 6: alternating current power supply
8: positive-side transformer
9: negative-side transformer
8*a*, 9*a*: ground terminal
8*b*, 9*b*: power supply terminal
10: positive-side high-voltage output circuit
11: negative-side high-voltage output circuit
13: first input terminal
14: second input terminal
15: first output terminal
16: attenuating capacitor
20: third input terminal
21: fourth input terminal
22: second output terminal
23: connection line
D1 to D8: diode
C1 to C8: capacitor
R1: first resistor
R2: second resistor

The invention claimed is:

1. An ionizer comprising:

a positive-side transformer and a negative-side transformer, each of which has a primary side and a secondary side, the primary sides of the positive-side transformer and negative-side transformer being alternately connected to an alternating current power supply by a switch mechanism, and also has a ground terminal and a power supply terminal on the secondary side;

a positive-side high-voltage output circuit that has a first input terminal, a second input terminal, and a first output terminal, the first input terminal being connected to the ground terminal in the positive-side transformer, the second input terminal being connected to the power supply terminal in the positive-side transformer, a direct-current positive high voltage being output from the first output terminal;

a negative-side high-voltage output circuit that has a third input terminal, a fourth input terminal, and a second output terminal, the third input terminal being connected to the ground terminal in the negative-side transformer, the fourth input terminal being connected to the power supply terminal in the negative-side transformer, a direct-current negative high voltage being output from the second output terminal;

a discharge electrode connected to the first output terminal in the positive-side high-voltage output circuit;

a ripple-voltage attenuating capacitor that mutually connects the ground terminal in the positive-side transformer and the first input terminal in the positive-side high-voltage output circuit; and a connection line that mutually connects the second output terminal in the negative-side high-voltage output circuit and the first input terminal in the positive-side high-voltage output circuit.

2. The ionizer according to claim 1, wherein the first output terminal and first input terminal in the positive-side high-voltage output circuit are mutually connected through a first resistor, and the second output terminal and third input terminal in the negative-side high-voltage output circuit are mutually connected through a second resistor.

3. The ionizer according to claim 1, wherein the positive-side high-voltage output circuit and negative-side high-voltage output circuit are each formed with a Cockcroft-Walton circuit including a diode and a capacitor.

4. The ionizer according to claim 2, wherein the positive-side high-voltage output circuit and negative-side high-voltage output circuit are each formed with a Cockcroft-Walton circuit including a diode and a capacitor.

* * * * *